United States Patent [19]

Nyenbrink

[11] Patent Number: 4,660,324

[45] Date of Patent: Apr. 28, 1987

[54] DOOR OPENER

[76] Inventor: Willard H. Nyenbrink, 6549 Fillmore St., Allendale, Mich. 49401

[21] Appl. No.: 771,272

[22] Filed: Aug. 30, 1985

[51] Int. Cl.[4] ..... E05F 11/24

[52] U.S. Cl. ..... 49/340; 49/139

[58] Field of Search ..... 49/340, 139, 140, 264, 49/342

[56] References Cited

U.S. PATENT DOCUMENTS

| | | | |
|---|---|---|---|
| 2,591,693 | 4/1952 | Gatesy | 49/139 X |
| 2,639,142 | 5/1953 | Morgan et al. | 49/340 |
| 2,900,791 | 8/1959 | Kinsey, Jr. | 49/264 X |
| 2,947,534 | 8/1960 | Leimer et al. | 49/139 |
| 3,284,950 | 11/1966 | Gute | 49/340 X |
| 3,314,195 | 4/1967 | Ziegler | 49/342 |
| 3,874,117 | 4/1975 | Boehm | 49/340 X |
| 4,253,276 | 3/1981 | Peterson et al. | 49/342 X |
| 4,348,835 | 9/1982 | Jones et al. | 49/140 X |

*Primary Examiner*—Philip C. Kannan

*Attorney, Agent, or Firm*—John A. Waters

[57] ABSTRACT

A door opener is secured to a door jamb on the hinge side. A radius arm extends from a vertical-axis shaft, and overlies the door. Force is transferred to the door by a roller mounted at the outer end of the arm on an axis parallel to the shaft.

7 Claims, 7 Drawing Figures

DOOR OPENER

BACKGROUND OF THE INVENTION

Devices for opening doors have been well established commercially for many years. They are most commonly employed for use by handicapped people and commonly include some form of actuator secured to the structure surrounding the door and suitable controls positioned so that someone in a wheelchair can energize the system conveniently. The door-opening mechanism is usually associated with some form of door closer, with the two systems occasionally being integrated into one device. In either case, these units have usually been mounted on the structure above the door that joins the two door jambs, which is commonly referred to as the header. In the design of modern buildings, the header structure is frequently reduced to a very small vertical dimension or eliminated entirely so that the door extends all the way to the ceiling. Obviously, this presents a problem in the mounting of conventional door-opening equipment.

The actuating mechanism of a conventional door opener usually consists of some form of electric motor, the main function of which is to generate torque in a shaft carrying a radius arm that extends out over the door. Force is transferred to the door usually through the use of a link pivoted at one end to the end of the radius arm, and at the other end to a suitable bracket secured to the door. This arrangement presents some problems in installation, particularly if it becomes necessary to accommodate unknown interior structure of the door for a suitable location for the bracket fastenings. The pivoted link arrangement also requires that attention be given to the adjustment of the length of the link and the placement of the bracket so that the pivot connection with the radius arm does not pass "over center", and interfere with the operation of the mechanism. Also, with a linkage mechanism, if the door is also to be operated manually, the linkage and door opener are forced to travel even when the door is operated manually.

SUMMARY OF THE INVENTION

The actuating mechanism of a door opener is mounted on a bracket secured to the inside suface of a door jamb. A vertical shaft carries a radius arm overlying the door, and a roller transfers force from the outer end of the radius arm to the surface of the door. The opener preferably operates in conjunction with, but independently of, a door closer.

DESCRIPTION OF THE DRAWINGS

FIG. 3 is on an enlarged scale over that of FIGS. 1 and 2.

DESCRIPTION OF THE PREFERRED EMBODIMENT

Figure 1:
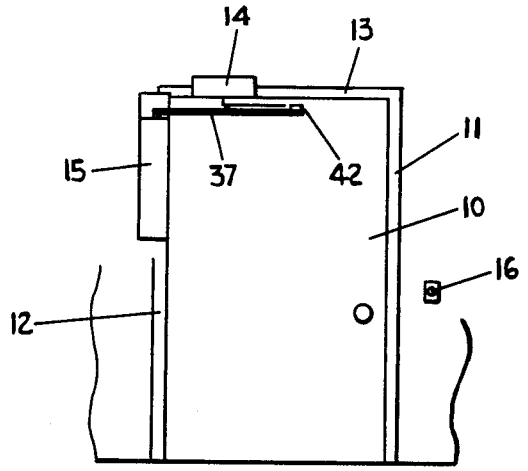
FIG. 1 is a front elevation showing the installation of a door opener in operating relationship with a door, and in conjunction with a door closer.
Figure 2:
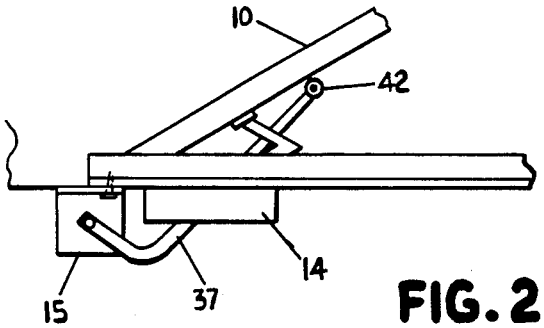
FIG. 2 is a top view showing the door opener as it functions, with the door in a partially open position.
Figure 3:
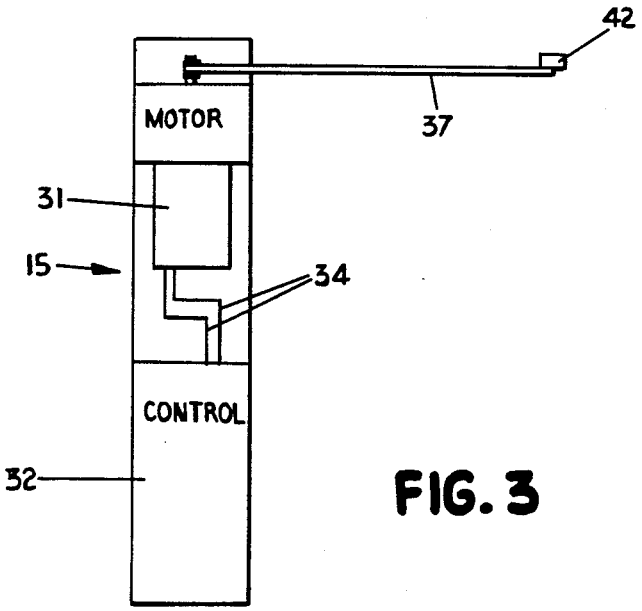
FIG. 3 is a schematic view showing the components of the door opener mechanism separately from the door structure.

Referring particularly to FIGS. 1 and 2, the door 10 is shown mounted between the jambs 11 and 12, with the door being hinged to the jamb 12. A header structure indicated at 13 extends over the top of the door opening interconnecting the jambs 11 and 12. In some forms of building construction, the jambs 11 and 12, and the header 13 are not visible on the exterior and are incorporated in the framing of the door opening. A conventional door closer is indicated at 14. The actuating mechanism of a door opener provided by the present invention is indicated generally at 15. A suitable wall-mounted push button is shown at 16 for controlling the door opener through wiring (not shown) concealed in the wall structure.

Figure 5:
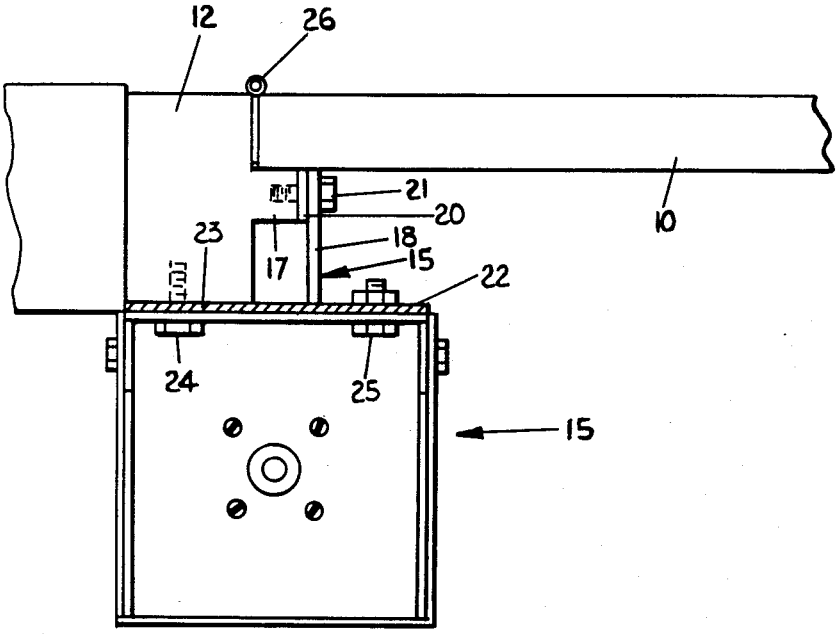
FIG. 5 is a sectional top view taken along line 5—5 of FIG. 6 showing the arrangement for securing the device to the door jamb.

The mounting of the door opener is best shown in FIG. 5. The jamb 12 has a central ridge 17, which is commonly referred to as the "stop", and is the structure against which the door 10 closes. The central flange 18 of a bracket generally indicated at 19 is secured to the inside face (the surface facing the door opening) of the stop 17, with spacer 20 being interposed if necessary to accommodate particular dimensional relationships. The bolt 21 secures the flange 18 to the jamb 12 at the stop 17. The opposite coplanar flanges 22 and 23 provide a mounting surface for the door opener 15, which is secured to these flanges by the bolts 24 and 25, with the bolt 24 also engaging the jamb 12. One of the door hinges is indicated at 26. The central leg or flange 18 of the T-shaped mounting bracket desirably is offset from the center of the top portion or arms or flanges 22 and 23. This facilitates mounting the bracket on a standard door jamb.

The leg 18 of the bracket does not extend the full length of the bracket but terminates short of the end on each end of the bracket. The top portion extends beyond the flange to form a face plate 50 on each end of the bracket. The face plate extends upwardly over the surface of the header and is bolted thereto by machine bolts 52. This enhances the stability of the mounting.

Because the leg 18 is offset from the center of the top portion of the bracket, the bracket cannot be symmetrically used for doors that are hinged on the opposite side. To do this, the bracket is simply turned upside down so that the face plate on the bottom extends upwardly. All the mounting openings are symmetrically placed so that the same mounting holes can be used.

If a particular door jamb is of unusual dimensions, a spacer 20 of any necessary thickness can be employed to adjust the shape of the door jamb to fit the T-shaped bracket.

The T-shaped bracket provides a strong mounting for most commercial dooways. However, it is recognized that the mounting bracket might not be essential in all applications and that the opener could be mounted directly to the wall or front surface of the jamb.

Figure 4:
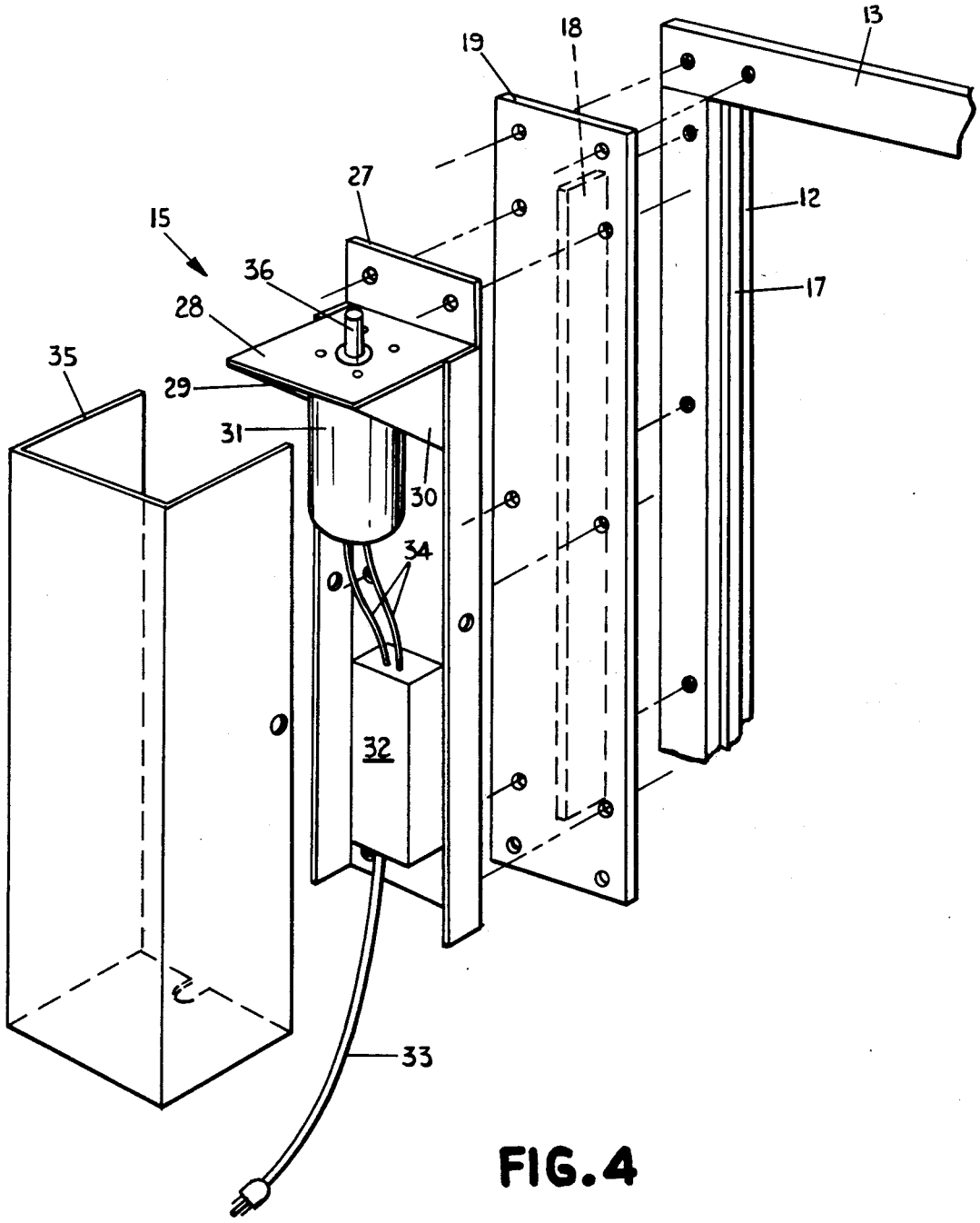
FIG. 4 is an exploded view on an enlarged scale showing the components of the preferred form of the invention.

The components of the door opener are shown best in FIG. 4. A channel 27 forms a frame for the device, and a transverse plate 28 is welded to this channel as shown, with the corner gussets 29 and 30 added to stabilize the position. The plate 28 forms the support for the motor unit 31, which is preferably of the low-speed, DC type. Conventional components are installed in the container 32 for converting the usual AC current received through the wire 33 to the DC voltage supplied to the motor 31 through the wires 34. A housing 35 is formed of plastic to appropriate dimensions to slip over the channel frame 27 to conceal the interior equipment, and protect it. These components are all secured together through appropriate screw fastenings.

Figure 7:
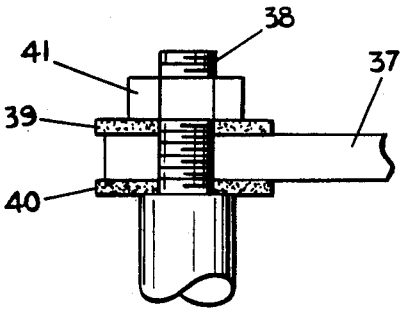
FIG. 7 is a sectional view on an enlarged scale showing the attachment of the radius arm to the actuator shaft.
Figure 6:
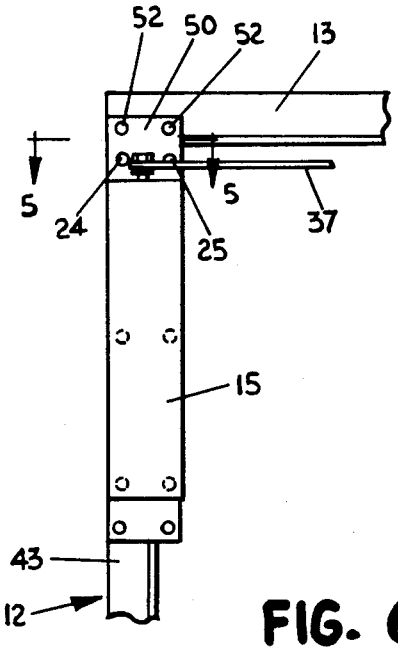
FIG. 6 is a fragmentary front elevation showing the mounting of the device on a door jamb.

Referring now to FIGS. 1, 2, and 7, the shaft 36 of the motor 31 projects upward to a position where it can receive the radius arm 37. The shaft 36 has a threaded end portion 38 of reduced diameter which receives the inner end of the radius arm 37, together with the friction washers 39 and 40. The nut 41 is of a type commonly known as and "elastic stop nut", which has a high resistance to turning on the threads of the shaft extension 38. The structure shown in FIG. 7 constitutes a clutch structure establishing a maximum torque which the shaft 36 can apply to the radius arm 37 (or vice versa). This torque generates a force at the outer extremity of the radius arm 37 which is applied to the door surface through a low-friction contact member such as a roller 42. The stability of the mounting of the device to form a solid base for the transfer of this torque is enhanced considerably by the attachment of the bracket 19 to the jamb of the door at both the inside face of the stop 17, and to the front face 43 of the jamb 12. In particular instances where this form of attachment is not practical, the space between the stop 17 and the plane of the front of the door jamb can be occupied by a filler block, and additional bolts extended through the flange 18 and this filler block, and into the jamb 12.

The operation of the device is very simple. A gentle push on the button 16 will energize the motor 31, which will proceed to rotate the shaft 36 and the radius arm 37. This action will apply force to the door through the roller 42, which will roll across the surface of the door as the door swings open as shown in FIG. 2. Regulations require that the door open slowly enough so that it will not produce a danger of collision with objects on the opposite side of the door, or with people who may be approaching it. It is commonly accepted that a rate of door opening must be such that at least 3 seconds is required for the door to swing to the fully open position. This time can be adjusted by the control mechanism. If an object or a person is encountered during this movement, the motor 31 will stop until the obstruction is removed. If a person tries to shut the door and overpower the opener, this will let the door close and the arm slip on the output shaft 36, without damaging the motor. When the door has reached the fully open position, or has encountered some object that limits its opening, the motor will continue to run for an adjustable period of time upto approximately thirty seconds. Then the control mechanism automatically shuts off the current by a conventional means such as a timer switch. The door will then swing back to its closed position under the action of the door closer 14. The door can be opened freely by hand, without involving the opening mechanism, simply because the door moves away from the arm 37.

I claim:

1. A selectively operable automatic door opener for opening an outwardly pivotable door that is mounted in a door jamb and has a header extending over the door, the door jamb having a vertical front face and having an inside surface facing across the door opening, the door opener comprising:

a bracket adapted to be secured to the door jamb, the bracket having a mounting surface that is secured to the vertical front face of the door jamb and a flange extending outwardly from the mounting surface that is secured to the inside surface of the door jamb, the mounting surface extending downwardly from the top of the door along the front face of the door jamb;

a door opener mounted on the mounting surface the bracket, the door opener comprising a motor driven radius arm that pivots in a direction to engage and apply an opening force to the door;

transfer means for transferring force from the arm to the door so as to open the door; and control means for actuating the motor to open the door.

2. A door opener according to claim 1 wherein the mounting surface extends upwardly to a position opposite the header above the door and is attached to the header by fasteners.

3. A door opener according to claim 1 wherein the bracket has a generally T-shaped configuration, with the arms of the "T" being the mounting surface and the leg of the "T" being the flange that is attached to the inside surface of the door jamb, the door opener being mounted on the arms of the mounting surface.

4. A door opener according to claim 3 wherein a portion of the mounting surface extends upwardly beyond the top of the flange, said portion being fastened to the header above the door.

5. A door opener according to claim 4 wherein the bracket is formed symmetrically such that it can be mounted on a door jamb at the opposite side of the door opening by turning it upside down, the mounting surface extending beyond the flange at both ends of the bracket such that either end can be attached to the header when positioned upwardly.

6. A door opener according to claim 1 wherein the transfer means comprise a free end of the rod that engages the door when the rod is pivoted against the door, the free end transferring an opening force against the door but moving sideways along the face of the door as the door opens, the free end and door being freely separable such that if the door is opened manually, the arm does not move with the door.

7. A door opener according to claim 6 wherein the free end of the arm includes a roller that provides a low-friction rolling contact with the door.

* * * * *